United States Patent [19]

Hewison

[11] Patent Number: 4,604,921

[45] Date of Patent: Aug. 12, 1986

[54] ADJUSTABLE CONTROL ASSEMBLIES

[75] Inventor: George D. Hewison, Hampshire, England

[73] Assignee: ITW Limited, Camberley, England

[21] Appl. No.: 736,206

[22] Filed: May 20, 1985

[30] Foreign Application Priority Data

May 24, 1984 [GB] United Kingdom ..... 8413275

[51] Int. Cl.[4] ..... B25B 23/00

[52] U.S. Cl. ..... 81/429

[58] Field of Search ..... 81/429

[56] References Cited

U.S. PATENT DOCUMENTS 2,796,161 6/1957 Graybill ..... 81/429

3,056,441 10/1962 Helms ..... 81/429

3,454,059 7/1969 Sindelar ..... 81/429

*Primary Examiner*—James L. Jones, Jr.

*Attorney, Agent, or Firm*—David I. Roche; Thomas W. Buckman

[57] ABSTRACT

An adjustable control assembly comprises first abutment means such as a U-shaped foot for placement against a workpiece, the first abutment means being provided on first spacing means such as a rod which is movable with respect to second abutment means such as a nut-like member, the second abutment means being provided on second spacing means such as a hollow tube which is movable with respect to third abutment means such as a combined pinch bracket and locator tube for attachment to a worktool, the preset distance between the first and third abutment means being adjustable to correspond to the desired initial position of the worktool with respect to the workpiece, and the preset distance between the second and third abutment means being adjustable to correspond to the maximum permitted advance of the worktool with respect to the workpiece, the preferred application of the adjustable control assembly being in the use of a rotary power tool to secure, to roof decking, a fastening assembly including an extensible resilient element passing through compressible insulation material.

8 Claims, 3 Drawing Figures

ADJUSTABLE CONTROL ASSEMBLIES

The present invention relates to adjustable control assemblies which are particularly but not exclusively suitable for use with the fastening assemblies of British patent applications Nos. 8400388 and 8413277 (now combined as European patent application No. 84308623.2).

An important application for those fastening assemblies is in fastening a relatively thick layer of compressible insulation material onto a relatively thin roof decking. The insulation material, which may be a mineral wool mat, is secured in place by an array of the fastening assemblies to the roof decking, which may be a thin metal sheet. The insulation material and the fastening assemblies are then covered by a waterproof membrane, for example a butyl rubber sheet or a combination of roofing felt and a bitumastic sealing compound. The fastening assemblies should not puncture the waterproof membrane when the insulation material is compressed, and the fastening assemblies should not be pulled through the insulation material when the insulation material is lifted from the roof decking.

According to the earlier of the above-referenced inventions, a fastening assembly for use in fastening a thick insulating layer onto a roof decking comprises a self-drilling and self-tapping screwthreaded fastener having a driving head; a load distributing plate for engaging the upper surface of the insulation material to hold the insulation material and distribute the fastening load so that the fastening assembly does not pull through the insulation material; and, an extensible resilient element having one end coupled to the head of the screwthreaded fastener and the other end coupled to the load distributing plate, at least one of the couplings permitting the screwthreaded fastener to rotate with respect to the load distributing plate to allow the fastener to be driven through and screwed into the roof decking to fasten the insulation material.

The provision of the resilient element between the load distributing plate and the screwthreaded fastener enables the insulation material to be held under a substantially constant compressive load irrespective of minor variations in the manufacture of the insulation material and distortions and deformations of the insulation material that occur in use.

Such deformations can occur by the ageing of the insulation material, or during the application of an external load to the roof, for example a snow loading or wind loading, as a result of workmen walking on the roof, or settling of the insulation material at corrugations of the roof decking, or thermal expansion and contraction or settlement of the building.

A vapour barrier may be provided by a vapour retardant membrane located between the top of the roof decking and the lower surface of the insulation material. The purpose of the vapour barrier is to discourage water vapour passing upwards through the insulating material and then condensing on the lower, inner surface of the waterproof membrane with a resulting accumulation of water in the roof structure above the roof decking. The problem is to ensure that the effectiveness of the vapour barrier is not significantly reduced even though the screwthreaded fasteners necessarily puncture the vapour retardant membrane.

According to the latter of the above-referenced inventions, the fastening assembly also includes a rubber or rubber-like elastomeric washer located beneath the coupling between the head of the screwthreaded fastener and the resilient element, so that, in use, the rubber or rubber-like elastomeric washer is located between the coupling and the vapour barrier located on top of the roof decking.

It will be appreciated that, when fastening one of the above-discussed fastening assemblies in place, the screwthreaded fastener is not visible to the operator, but is hidden from view by the insulation material, and indeed by the resilient element and the load distributing plate.

It is, however, of importance that the operator should know that the screwthreaded fastener has been properly fastened to the roof decking. If the screwthreaded fastener has been underdriven, the resilient element will not have been stretched to the predetermined desired extent, and additionally the connection between the screwthreaded fastener and the roof decking might be incapable of withstanding the predetermined pull-out load. If the screwthreaded fastener has been overdriven, the connection between the screwthreaded fastener and the roof decking might be stripped or otherwise damaged and again be incapable of withstanding the predetermined pull-out load.

A further difficulty is that it has recently been proposed to convert a flat roof into a sloping roof having a shallow pitch, for example to assist in dispersal of rainwater, by providing a graduated thickness of the insulation material over the roof decking. A result of this is that some areas of the insulation material may have a thickness which is considerably greater than the thickness of other areas of the insulation material. The fastening assemblies are conveniently of different sizes dependent upon the thickness of the insulation material. More particularly, the resilient elements may be of different length and/or may be stretched to different extents dependent upon the thickness of the insulation material.

According to the present invention, an adjustable control assembly comprises first abutment means for placement against a workpiece, the first abutment means being provided on first spacing means which is movable with respect to second abutment means, the second abutment means being provided on second spacing means which is movable with respect to third abutment means for attachment to a worktool, the preset distance between the first and third abutment means being adjustable to correspond to the desired initial position of the worktool with respect to the workpiece, and the preset distance between the second and third abutment means being adjustable to correspond to the maximum permitted advance of the worktool with respect to the workpiece.

In use of the adjustable control assembly of the present invention, with the fastening assemblies of the above-referenced inventions, the worktool is a rotary power driver having an elongate drive shank with a drive head at its free end, and the workpiece is the insulation material, the vapour retardant membrane and the roof decking.

The distance between the first and third abutment means is set such that, with the first abutment means placed against the insulation material, the drive head of the rotary power tool would be in engagement with the driving head of the screwthreaded fastener of the fastening assembly, the resilient element as yet being unstretched. The distance between the second and third abutment means is set such that the maximum permitted advance of the rotary power tool, corresponding to the amount by which the resilient element is stretched, would be that necessary to drive the screwthreaded fastener into an optimum connection with the roof decking.

To facilitate the setting of the distance between the first and third abutment means, the load distributing plate of the fastening assembly may be pre-assembled with the first abutment means of the adjustable control assembly. The setting of the distance between the second and third abutment surfaces needs to be calculated in advance, primarily to ensure that the resilient element is sufficiently stretched to take account of the expected compression of the insulation material over a period of time, and the calculation may well need to take account of compression of the insulation material to be expected as a result of the actual fastening operation. After said two settings have been established, a plurality of fastening assemblies of a given size can be fastened to a given thickness of insulation material without further adjustment of the adjustable control assembly.

Preferably, the distance between the second and third abutment means is adjustable independently of the distance between the first and third abutment means. A practical advantage of this is that a given size of fastening assembly can be used over a range of different thicknesses of insulation material. The distance between the first and third abutment means remains the same because the size of the fastening assembly remains the same, but the distance between the second and third abutment means is adjusted to take account of the different thicknesses of insulation material.

It would be possible for the second abutment means, which is of course located between the first and third abutment means, to perform simultaneously to its abutting function, the function of releasably securing the first and second spacing means to one another. In fact, it is much more convenient for connector means entirely separate from the second abutment means to be provided for said releasable securing of the first and second spacing means. It is then possible to arrange the second abutment means to be movable with respect to the second spacing means without fear of inadvertently adjusting the setting of the distance between the first and third abutment means.

The reader should be aware that the adjustable control assembly of the present invention is capable of use in applications other than with the fastening assemblies of the above-referenced inventions and should further be aware that the following preferred features are not necessarily preferable in the given circumstances of such other applications.

The first abutment means may be no more than a free end surface of the first spacing means. It is preferred, however, that the first abutment means is of relatively large surface area for spreading the load applied to the insulation material during the fastening operation. The first abutment means may, for example, include a U-shaped foot. It is also preferred, as already mentioned, that the first abutment means is capable of being pre-assembled with the load distributing plate. This pre-assembly can be achieved by forming the load distributing plate with a rebate around its periphery to provide a lip capable of snapping into an annular recess past a series of for example four circumferentially spaced lugs presented by the U-shaped foot. The angular orientation of the fastening assembly with respect to the first abutment means is thus of no concern. During driving of the screwthreaded fastener, any tendency for the rotary power tool to move laterally out of position may be counteracted by the provision of a cover for the U-shaped foot, the cover having a hole through which the elongate drive shank of the rotary power tool is to extend. When the fastening assembly has been secured in place, the rotary power tool and the adjustable control assembly attached thereto are merely pulled away. The lugs either snap past the lip of the load distributing plate or break the lip of the load distributing plate locally. The appearance of this does not matter because in use the load distributing plate is hidden from view by the waterproof membrane.

The first spacing means is preferably in sliding telescopic association with the second spacing means. The first spacing means may be located to the outside or the inside of the second spacing means. The first spacing means is preferably, however, in the form of a rod with the second spacing means then being in the form of a hollow tube.

The second abutment means, as already mentioned, is preferably entirely separate from connector means for releasably securing the first and second spacing means to one another. A preferred connector means involves providing longitudinally extending slots in a free end of the hollow tube forming the second spacing means, and further providing a pinch bracket for squeezing said slotted end of the hollow tube onto the rod forming the first spacing means. The connector means may however be of any other known construction. The second abutment means is preferably in the form of an internally threaded nut-like member in threaded engagement with an externally threaded portion of the hollow tube forming the second spacing means. To resist inadvertent displacement of the second abutment means due to vibration, for example, said nut-like member may be provided with internally projecting, circumferentially spaced, spring loaded balls for snap engagement with a series of correspondingly circumferentially spaced, longitudinally extending grooves formed in said externally threaded portion of the hollow tube. The second abutment means could however be of any other known construction. It will be appreciated that the nut-like member can be screwed in either direction along the hollow tube without needing to release the pinch bracket squeezing the hollow tube onto the rod.

The third abutment means is preferably in the form of a combined pinch bracket and locator tube. The locator tube receives the hollow tube forming the second spacing means in such a manner that the second abutment means is located beyond one end of the locator tube and an enlarged head at the unslotted end of the hollow tube is located beyond the other end of the locator tube. When the enlarged head is pressing against the locator tube, the distance between the second and third abutment means can be accurately set. The pinch bracket combined with the locator tube is to be secured to a chuck portion of the rotary power tool.

The manner of operation of an adjustable control assembly incorporating all of the preferred features is as follows:

The load distributing plate of a chosen fastening assembly is snapped into engagement with the lugs on the U-shaped foot;

The connector means securing the rod and hollow tube together is released and the rotary power tool is advanced until its drive shank engages the screwthreaded fastener;

The hollow tube is positioned such that its enlarged head is pressing against the locator tube and the connector means is then secured to set the distance between the first and third abutment means;

The nut-like member is screwed along the hollow tube towards or away from the locator tube to set the distance between the second and third abutment means (checked by a ruler, or a measuring block, or the like);

The fastening assembly is pressed into position until the U-shaped foot is placed against the insulation material; and The screwthreaded fastener is driven into the roof decking until the locator tube has been moved into abutment with the nut-like member.

An adjustable control assembly, in accordance with the present invention, will now be described, by way of example only, with reference to the accompanying drawings, in which.

An adjustable control assembly in accordance with the present invention is particularly suitable for use with a fastening assembly of the kind disclosed in British patent applications Nos. 8400388 and 8413277 (now combined as European patent application No. 84308623.2).

Figure 1:
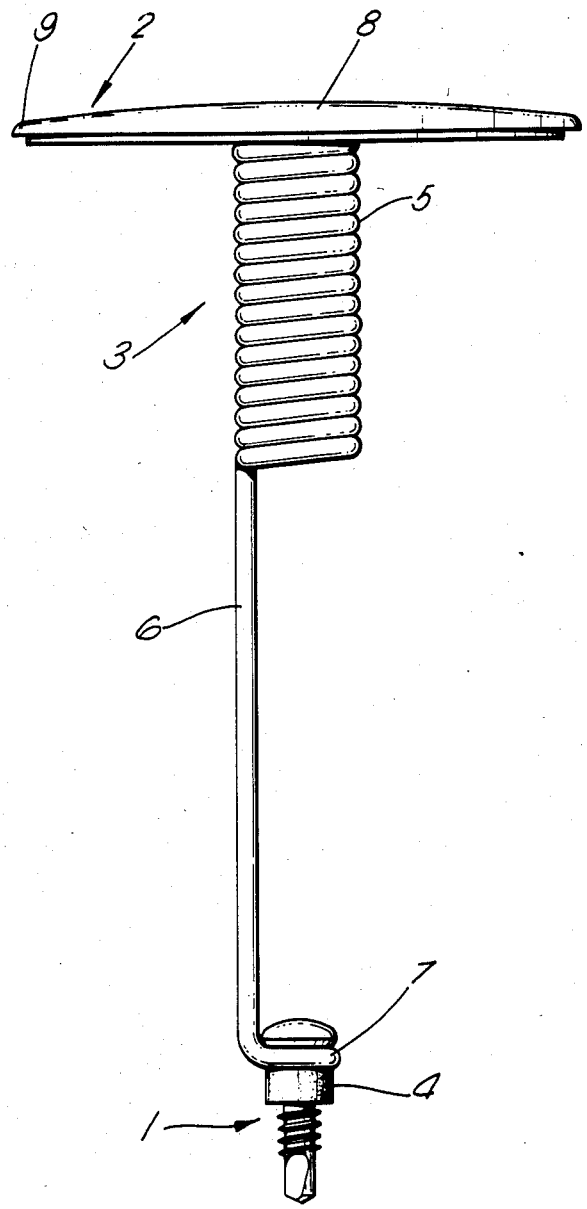
FIG. 1 is a side view of a fastening assembly for use with thick insulation material.

Such a fastening assembly is shown in FIG. 1 and includes a self-drilling, self-tapping screwthreaded fastener 1, a load distributing plate 2, an extensible resilient element 3 and a rubber or rubber-like elastomeric washer 4. The extensible resilient element 3 is formed by a helically wound galvanised high tension spring 5 having a number of turns dependent upon the expected compression of the insulation material, and having at its lowermost end an axially extending arm portion 6 which varies in length and which terminates in a single turn 7 of small diameter. The other end of the spring 5 is wound onto a threaded projection depending from the underside of a domed head 8 of the load distributing plate 2. The domed head 8 also has radial ribs on its underside, and a central bore through which an elongate drive shank may pass to reach the screwthreaded fastener 1. A rebate is formed around the periphery of the domed head 8 to provide a lip 9.

Figure 2:
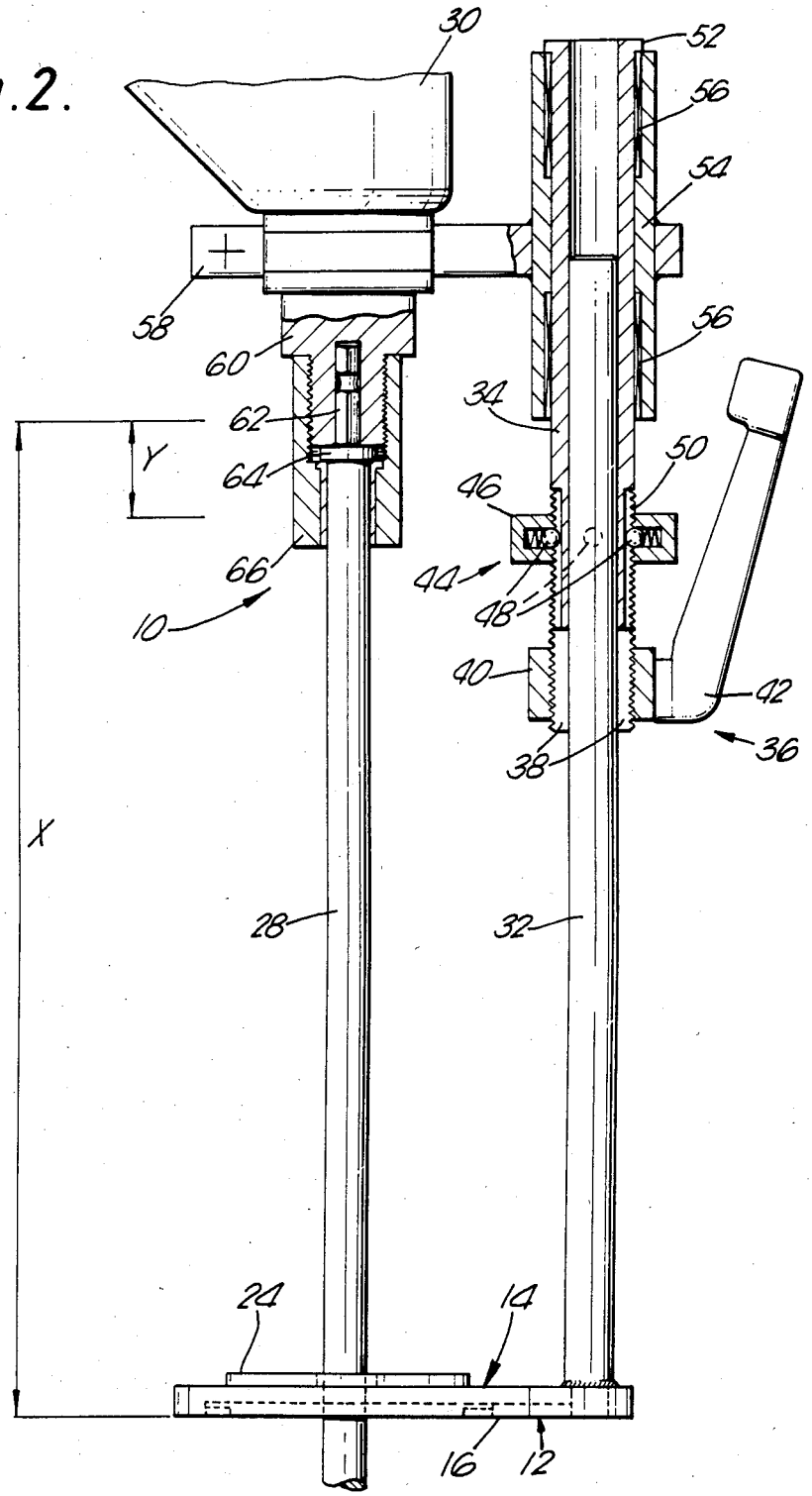
FIG. 2 is a side view, in partial longitudinal section, of an adjustable control assembly also showing part of a rotary power tool, the adjustable control assembly being suitable for use with the fastening assembly of FIG. 1.
Figure 3:
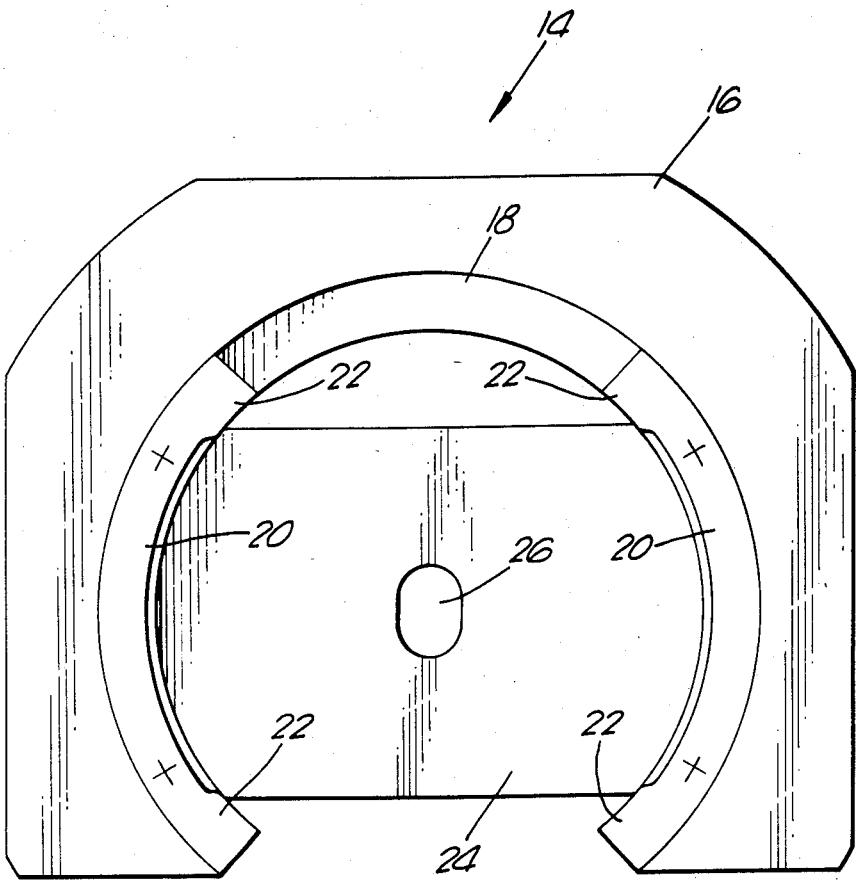
FIG. 3 is an enlarged underneath view of the lower part of the adjustable control assembly of FIG. 2.

An adjustable control assembly 10 in accordance with the present invention is shown in FIGS. 2 and 3.

The assembly 10 includes first abutment means 12 comprising a U-shaped foot 14 having a lower surface 16 which is to be placed, in use, against the upper surface of insulation material. The inner lower edge of the U-shaped foot 14 is formed with a rebate 18 into which two arcuate members 20 are secured. Each end of each of the arcuate members 20 is formed with a lug 22, the lugs 22 being spaced from the U-shaped foot 14 to present an annular recess for receiving the lip 9 of the load distributing plate 2. The upper face of the U-shaped foot 14 is secured to a cover 24 having a central hole 26 for receiving an elongate drive shank 28 of a rotary power tool 30.

The bight portion of the U-shaped foot 14 is secured to vertically extending first spacing means in the form of a rod 32. The upper end of the rod 32 is in sliding telescopic association with the lower end of second spacing means in the form of a hollow tube 34. The rod 32 can be adjustably secured within the hollow tube 34 by connector means 36.

The connector means 36 is provided by longitudinally extending slots 38 at the lower end of the hollow tube 34, and by a pinch bracket 40 which squeezes the slotted end of the hollow tube 34 when the handle 42 is turned. Turning the handle 42 in the opposite sense releases the pinch bracket 40.

Second abutment means 44 is also provided on the hollow tube 34, the second abutment means 44 being in the form of an internally threaded nut-like member 46 in threaded engagement with an externally threaded portion of the hollow tube 34. The nut-like member has four internally projecting, circumferentially spaced, spring loaded balls 48 for snap engagement with a series of correspondingly circumferentially spaced, longitudinally extending grooves 50 formed in the externally threaded portion of the hollow tube 34. The grooves 50 are longitudinal extensions of the slots 38. It will be appreciated that, as the nut-like member 46 is screwed in either direction along the hollow tube 34, the balls 48 are sequentially moved out of and into snap engagement with the grooves 50.

The upper end of the hollow tube 34 is formed with an enlarged head 52. The head 52 is located above a locator tube 54, through which the hollow tube 34 extends, with the nut-like member 46 being located below the locator tube 54. Bearings 56 may be provided to assist in sliding movement of the locator tube 54 over the hollow tube 34. The locator tube 54 is combined with a further pinch bracket 58 which is secured to a chuck portion 60 of the rotary power tool 30. The combined locator tube 54 and pinch bracket 58 constitute third abutment means. The pinch bracket 58 can be secured to the chuck portion 60 by a threaded member forming one end of a handle.

In addition to a conventional snap-fit connection 62 between the drive shank 28 and the chuck portion 60, the drive shank 28 may be provided with a flange 64 sandwiched between the chuck portion 60 and a nosepiece 66 in threaded engagement with the chuck portion 60. This arrangement ensures that the drive shank 28 remains secured to the chuck portion 60 when the rotary power tool 30 and the adjustable control assembly 10 are pulled away from the load distributing plate 2 after completion of the fastening operation. The nosepiece 66 also helps the hole 26 in the cover 24 to stabilise the drive shank 28.

The distance between the first and third abutment means is indicated by reference X (from the lower surface of the locator tube 54 to the lower surface of the U-shaped foot 14) and the distance between the second and third abutment means is indicated by the reference Y (from the lower surface of the locator tube 54 to the upper surface of the nut-like member 46).

Although a full explanation of the intended manner of use has already been given it may be convenient to remind the reader of the following relationships. The distance X between the first and third abutment means is set such that, with the U-shaped foot 14 placed against the insulation material, the drive head of the rotary power tool 30 is in engagement with the driving head of the screwthreaded fastener 1 of the fastening assembly, the resilient element 3 as yet being unstretched. The distance Y between the second and third abutment means is set such that the maximum permitted advance of the rotary power tool 30, corresponding to the amount by which the resilient element 3 is stretched, would be that necessary to drive the screwthreaded fastener 1 into an optimum connection with the roof decking.

I claim:

1. An adjustable control assembly comprising first abutment means for placement against a workpiece, the first abutment means being provided on first spacing means which is movable with respect to second abutment means, the second abutment means being provided on second spacing means which is movable with respect to third abutment means for attachment to a worktool, the first and second spacing means being releasably secured together by connector means entirely separate from the second abutment means, the connector means providing longitudinally extending slots in a free end of a hollow tube forming the second spacing means, and further providing a pinch bracket for squeezing said slotted end of the hollow tube onto a rod forming the first spacing means, the preset distance between the first and third abutment means being adjustable to correspond to the desired initial position of the worktool with respect to the workpiece, and the preset distance between the second and third abutment means being adjustable to correspond to the maximum permitted advance of the worktool with respect to the workpiece.

2. An adjustable control assembly according to claim 1, in which the distance between the second and third abutment means is adjustable independently of the distance between the first and third abutment means.

3. An adjustable control assembly according to claim 1, in which the first abutment means is a U-shaped foot of relatively large surface area for spreading load applied to the workpiece.

4. An adjustable control assembly according to claim 1, in which the first abutment means is pre-assemblable with a fastening assembly.

5. An adjustable control assembly according to claim 3, in which the U-shaped foot has an annular recess into which an edge of a plate of a fastening assembly can be snapped past a series of circumferentially spaced lugs presented by the U-shaped foot.

6. An adjustable control assembly according to claim 1, in combination with a fastening assembly, a workpiece and a worktool, the worktool being a rotary power driver and the workpiece being insulation material on roof decking.

7. An adjustable control assembly comprising first abutment means for placement against a workpiece, the first abutment means being provided on first spacing means which is movable with respect to second abutment means, the second abutment means being provided on second spacing means which is movable with respect to third abutment means for attachment to a worktool, the preset distance between the first and third abutment means being adjustable to correspond to the desired initial position of the worktool with respect to the workpiece, and the preset distance between the second and third abutment means being adjustable to correspond to the maximum permitted advance of the worktool with respect to the workpiece, the first and second spacing means being in sliding telescopic association with one another, the first spacing means being a rod and the second spacing means is a hollow tube, the connector means providing longitudinally extending slots in a free end of a hollow tube forming the second spacing means, and further providing a a pinch bracket for squeezing said slotted end of the hollow tube onto a rod forming the first spacing means, the second abutment means being an internally threaded nut-like member in threaded engagement with an externally threaded portion of the hollow tube forming the second spacing means, the nut-like member being provided with internally projecting, circumferentially spaced, spring loaded balls for snap engagement with a series of correspondingly circumferentially spaced longitudinally extending grooves formed in said externally threaded portion of the hollow tube.

8. An adjustable control assembly comprising first abutment means for placement against a workpiece, the first abutment means being provided on first spacing means which is movable with respect to second abutment means, the second abutment means being provided on second spacing means which is movable with respect to third abutment means for attachment to a worktool, the present distance between the first and third abutment means being adjustable to correspond to the desired initial position of the worktool with respect to the workpiece, and the preset distance between the second and third abutment means being adjustable to correspond to the maximum permitted advance of the worktool with respect to the workpiece, the third abutment means being a combined pinch bracket and locator tube, the pinch bracket being provided for mounting on the worktool, and the locator tube being provided for receiving the second spacing means such that an enlarged head of the second spacing means is located beyond one end of the locator tube, and the second abutment means is located beyond the other end of the locator tube.

* * * * *